US009905326B2

(12) United States Patent
Kikuchi et al.

(10) Patent No.: US 9,905,326 B2
(45) Date of Patent: Feb. 27, 2018

(54) SEMICONDUCTIVE RESIN COMPOSITION AND POWER TRANSMISSION CABLE USING SAME

(71) Applicant: Hitachi Metals, Ltd., Tokyo (JP)

(72) Inventors: Ryutaro Kikuchi, Mito (JP); Akira Setogawa, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 112 days.

(21) Appl. No.: 14/819,873

(22) Filed: Aug. 6, 2015

(65) Prior Publication Data

US 2016/0148717 A1 May 26, 2016

(30) Foreign Application Priority Data

Nov. 20, 2014 (JP) ..... 2014-235119

(51) Int. Cl.
*H01B 1/24* (2006.01)

(52) U.S. Cl.
CPC ..... *H01B 1/24* (2013.01)

(58) Field of Classification Search
None
See application file for complete search history.

(56) References Cited

U.S. PATENT DOCUMENTS 3,878,319 A * 4/1975 Wahl ..... H01B 7/02 156/51
4,769,179 A * 9/1988 Kato ..... C08K 3/22 252/601
4,933,107 A 6/1990 Watanabe et al.
5,231,249 A * 7/1993 Kimura ..... H01B 3/44 174/105 SC
5,889,117 A * 3/1999 Flenniken ..... B32B 1/08 525/222
2006/0270783 A1* 11/2006 Beck ..... F16L 11/06 524/564
2015/0355430 A1* 12/2015 Clampitt ..... G02B 6/4495 385/103

FOREIGN PATENT DOCUMENTS

CN 103275401 * 9/2013
JP H 01-246708 A 10/1989
JP 09326210 * 12/1997

OTHER PUBLICATIONS

Product Data Sheet N650, Jan. 2003.*
Carbon Blacks for Rubber Extrusion, p. 2, Jan. 2008.*

* cited by examiner

*Primary Examiner* — Tanisha Diggs

(74) *Attorney, Agent, or Firm* — McGinn IP Law Group, PLLC.

(57) ABSTRACT

A semiconductive resin composition is composed of a base polymer including an ethylene-vinyl acetate copolymer with a vinyl acetate content of not lower than 60 percent by weight, two or more of fatty acid zinc, oleic acid bisamide and trimellitic acid ester, a peroxide-based crosslinking agent having a one hour half-life temperature of not lower than 130 degrees C., and a carbon having a DBP (dibutyl phthalate) adsorption capacity of not larger than 150 mg/g.

15 Claims, 3 Drawing Sheets

SEMICONDUCTIVE RESIN COMPOSITION AND POWER TRANSMISSION CABLE USING SAME

The present application is based on Japanese patent application No. 2014-235119 filed on Nov. 20, 2014, the entire contents of which are incorporated herein by reference.

BACKGROUND OF THE INVENTION

1. Field of the Invention

This invention relates to a semiconductive resin composition, particularly a semiconductive resin composition having a good easy peelability from an electrically insulating layer and extrudability, and a power transmission cable using that semiconductive resin composition in an outer semiconductive layer. It also relates to a semiconductive resin composition capable of forming an outer semiconductive layer excellent in electrical properties and mechanical properties, and to a power transmission cable using that semiconductive resin composition.

2. Description of the Related Art

Conventionally, power transmission cables are widely used, which are provided with an outer semiconductive layer around an electrically insulating layer made of a crosslinked polyethylene. (Refer to e.g. JP-A-1-246708.) The outer semiconductive layer is required to be in close contact with the electrically insulating layer, so as not to cause a corona discharge. On the other hand, when performing a terminal treatment for cable connection, etc., it is necessary to be able to easily remove the electrically insulating layer without damaging it. Therefore, the outer semiconductive layer having good adhesion and easy peelability from the electrically insulating layer is desired.

To produce such an outer semiconductive layer, there has conventionally been used the semiconductive resin composition derived from combining a base polymer made of a mixture of a polymer having no affinity for the electrical insulator, such as a polar polymer such as vinyl chloride, chlorinated polyethylene, ethylene vinyl acetate copolymer or the like, fluorine resin, silicone resin or the like, and a polyolefin resin, with an electrically conductive carbon black.

SUMMARY OF THE INVENTION

In the above-mentioned semiconductive resin composition, the use of the high polarity polymer such as an ethylene vinyl acetate copolymer having a high content of vinyl acetate, a chlorinated polyethylene vinyl chloride graft copolymer or the like as the polymer having no affinity for the electrical insulator allows an increase in polarity difference between it and the constituent resin of the electrical insulator, therefore allowing for holding a good peelability from the electrically insulating layer.

However, the above semiconductive resin composition had the problem that, when the outer semiconductive layer was extruded, that semiconductive resin composition had a high viscosity, and its abnormal appearance caused by charring (carbonization).

Accordingly, it is an object of the present invention to provide a semiconductive resin composition, which overcomes the foregoing problem, and which has a good easy peelability from an electrically insulating layer and extrudability, and a power transmission cable using that semiconductive resin composition in an outer semiconductive layer.

In order to achieve the above object, the present invention provides a semiconductive resin composition and a power transmission cable using that semiconductive resin composition described below.

(1) According to one embodiment of the invention, a semiconductive resin composition comprises:

- a base polymer including an ethylene-vinyl acetate copolymer with a vinyl acetate content of not lower than 60 percent by weight;
- two or more of fatty acid zinc, oleic acid bisamide and trimellitic acid ester;
- a peroxide-based crosslinking agent having a one hour half-life temperature of not lower than 130 degrees C.; and
- a carbon having a DBP (dibutyl phthalate) adsorption capacity of not larger than 150 mg/g.

In the one embodiment, the following modifications and changes may be made.

(i) The semiconductive resin composition includes not less than 5 parts by mass and not more than 20 parts by mass of the two or more of fatty acid zinc, oleic acid bisamide and trimellitic acid ester per 100 parts by mass of the base polymer.

(ii) The semiconductive resin composition includes not less than 0.5 parts by mass and not more than 3 parts by mass of the peroxide-based crosslinking agent, per a total of 100 parts by mass of the base polymer and the two or more of fatty acid zinc, oleic acid bisamide and trimellitic acid ester.

(iii) The semiconductive resin composition includes not less than 50 parts by mass and not more than 95 parts by mass of the carbon, per a total of 100 parts by mass of the base polymer and the two or more of fatty acid zinc, oleic acid bisamide and trimellitic acid ester.

(2) According to another embodiment of the invention, a power transmission cable comprises an outer semiconductive layer made of the semiconductive resin composition specified in (1) above.

(Points of the Invention)

The present invention provides the semiconductive resin composition, which overcomes the previously mentioned problem, and which has a good easy peelability from an electrically insulating layer and extrudability, and the power transmission cable using that semiconductive resin composition in the outer semiconductive layer.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

[Semiconductive Resin Composition]

Figure 1:
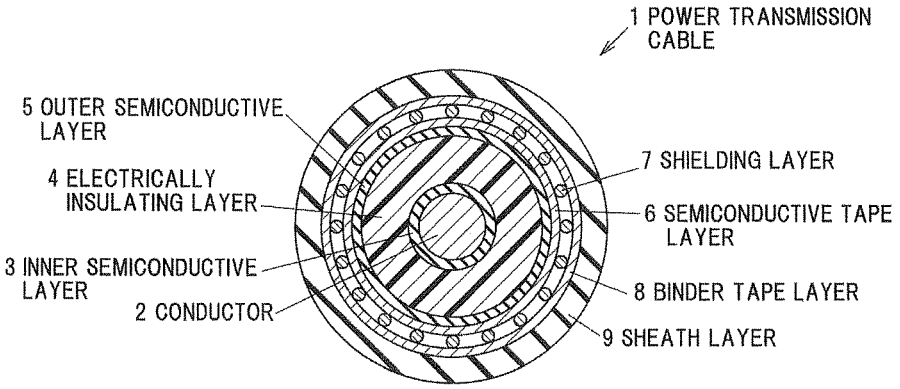
FIG. 1 is a cross-sectional view showing a power transmission cable in an embodiment of the present invention.

A semiconductive resin composition in an embodiment of the present invention is composed of a base polymer including an ethylene-vinyl acetate copolymer with a vinyl acetate content of not lower than 60 percent by weight, two or more of fatty acid zinc, oleic acid bisamide and trimellitic acid ester, a peroxide-based crosslinking agent having a one hour half-life temperature of not lower than 130 degrees C., and a carbon having a DBP (dibutyl phthalate) adsorption capacity of not larger than 150 mg/g.

(Ethylene-Vinyl Acetate Copolymer)

The semiconductive resin composition in the embodiment of the present invention contains the ethylene-vinyl acetate copolymer as the base polymer.

The ethylene-vinyl acetate copolymer to be used has a vinyl acetate content of not lower than 60 percent by weight. This is because if the vinyl acetate content is lower than 60 percent by weight, the peelability of the resulting outer semiconductive layer from an electrically insulating layer excessively lowers, thereby making it difficult to peel the outer semiconductive layer from the electrically insulating layer.

(Two or More of Fatty Acid Zinc, Oleic Acid Bisamide and Trimellitic Acid Ester)

The semiconductive resin composition in the embodiment of the present invention contains the two or more of fatty acid zinc, oleic acid bisamide and trimellitic acid ester. The fatty acid zinc, the oleic acid bisamide and the trimellitic acid ester are each a low viscosity modifier moderately compatible with the ethylene vinyl acetate copolymer used. Two or more of the fatty acid zinc, the oleic acid bisamide and the trimellitic acid ester are used in combination, because, in systems in which they are used as single agents, they, when lightly added therein, cannot prevent charring (carbonization), while they, when heavily added therein, increase lubricity, making extrusion molding impossible.

A: Fatty Acid Zinc

The fatty acid zinc to be used may be a zinc metal salt composed of one or more of stearic acid or lauric acid. Also, the trimellitic acid ester is composed of preferably an alkyl chain having eight or more carbons.

B: Oleic Acid Bisamide

The oleic acid bisamide is generally an external lubricant, but in the semiconductive resin composition in the embodiment of the present invention, it has a moderate affinity for the base polymer, and is therefore used in combination with the fatty acid zinc and the trimellitic acid ester, so that an internal lubricating effect also develops. This internal lubricating effect is considered to contribute to suppressing evolution of heat during extrusion.

C: Trimellitic Acid Ester

As the trimellitic acid ester, there are listed tri-2-ethylhexyl trimellitate, tri-normal-octyl trimellitate, tri-isononyl trimellitate, tri-propylheptyl trimellitate, tri-isodecyl trimellitate, tri-normal-decyl trimellitate, etc. They may be used as single agents or in combination. The trimellitic acid ester develops an internal plasticization effect in the semiconductive resin composition in the embodiment of the present invention. The use of the trimellitic acid ester as a single agent causes the mixture to have a slight viscosity, but this weakness of the trimellitic acid ester is considered to be overcome by its use in combination with the fatty acid zinc or the oleic acid bisamide.

The amount of the two or more of fatty acid zinc, oleic acid bisamide and trimellitic acid ester to be added is preferably not less than 5 parts by mass and not more than 20 parts by mass, more preferably the amount of the fatty acid zinc, the oleic acid bisamide and the trimellitic acid ester to be used together is not less than 6 parts by mass and not more than 17 parts by mass. This is because if the amount added is less than 5 parts by mass, no sufficiently low viscosity is ensured, while if the amount added exceeds 20 parts by mass, swelling is likely to occur due to too low viscosity.

(Peroxide-Based Crosslinking Agent Having a One Hour Half-Life Temperature of not Lower than 130 Degrees C.)

The semiconductive resin composition in the embodiment of the present invention contains the peroxide-based crosslinking agent having a one hour half-life temperature of not lower than 130 degrees C. This is because if the one hour half-life temperature of the peroxide-based crosslinking agent is lower than 130 degrees C., charring during extrusion is likely to occur, making extrusion difficult.

The semiconductive resin composition contains preferably not less than 0.5 parts by mass and not more than 3 parts by mass of the peroxide-based crosslinking agent having a one hour half-life temperature of not lower than 130 degrees C., per a total of 100 parts by mass of the base polymer and the two or more of fatty acid zinc, oleic acid bisamide and trimellitic acid ester, more preferably not less than 2 parts by mass and not more than 2.8 parts by mass, from the point of view of preventing charring (carbonization) during extrusion.

(Carbon Having a DBP Adsorption Capacity of not Larger than 150 mg/g)

The semiconductive resin composition in the embodiment of the present invention contains the carbon having a DBP (dibutyl phthalate) adsorption capacity of not larger than 150 mg/g. The carbon has more preferably a DBP adsorption capacity of around 50 mg/g, and a pellet shape property having an average particle size of around 30 μm.

This is intended to constitute a dispersed form divided into a matrix layer, in which carbons having a particle size of not greater than 30 μm are dispersed, and a domain layer, in which carbons having a particle size of around 30 μm are dispersed. The domain on the order of 30 μm is composed of aggregated carbon particles of the order of 30 nm, in which the carbon particles themselves maintain their shapes.

This phase structure is formed in the kneading step by the plasticization of the base polymer with the two or more components of fatty acid zinc, oleic acid bisamide and trimellitic acid ester, allowing the base polymer to have a low viscosity, and by the oil absorption effect of the peroxide-based crosslinking agent having a one hour half-life temperature of not lower than 130 degrees C. The presence of 100 μm or more domain layer causes breakdown and malfunction. For this reason, the above particle size is preferably not smaller than 30 μm and smaller than 100 μm. The kneading may be performed by using any kneading machine such as Banbury mixer, kneader, open roll, twin-screw extruder, or the like.

This phase structure is also suitable for enhancing the peelability of the outer semiconductive layer from the electrically insulating layer. Such uniform unevenness on the outer semiconductive layer that no projection and gap form between it and the electrical insulator develops a good peelability. If the domain on the order of 30 μm is on the order of 1 percent of the entire area, the peelability does not improve, and also if the domain on the order of 30 μm is 30 percent or higher of the entire area, there is the problem that peeling easily occurs. In the present method, the domain (corresponding to an island of sea-island structure) area occupancy is controlled on the order of not less than 5 percent and not more than 20 percent.

The amount of the carbon to be added is preferably not less than 50 parts by mass and not more than 95 parts by mass, more preferably not less than 60 parts by mass and not more than 80 parts by mass, per a total of 100 parts by mass of the base polymer and the two or more of fatty acid zinc, oleic acid bisamide and trimellitic acid ester. If the amount of the carbon to be added is the less than 50 parts by mass, no sufficient semiconductivity is obtained, while if the amount of the carbon to be added exceeds 95 parts by mass, the viscosity increases, making the extrusion difficult.

Also, in the semiconductive resin composition in the embodiment of the present invention, a silane coupling agent, a crosslinking reaction promoter, an antioxidizing agent, other lubricants, etc., if desired, can be compounded without impairing the effect of the semiconductive resin composition of the present invention.

[Cable]

FIG. 1 is a front view showing a power transmission cable in the embodiment of the present invention.

The power transmission cable 1 includes a conductor 2 made of a stranded wire, an inner semiconductive layer 3 formed around a circumference of the conductor 2, an electrically insulating layer 4 formed around an outer circumference of the inner semiconductive layer 3, an outer semiconductive layer 5 formed around an outer circumference of the electrically insulating layer 4, a semiconductive tape layer 6 formed by winding a semiconductive tape 60 around an outer circumference of the outer semiconductive layer 5, a shielding layer 7 formed by winding a wire 70 around an outer circumference of the semiconductive tape layer 6, a binder tape layer 8 formed by winding a binder tape 80 around an outer circumference of the shielding layer 7, and a sheath layer 9 formed around an outer circumference of the binder tape layer 8. The semiconductive resin composition in the embodiment of the present invention is applied to the aforementioned outer semiconductive layer 5.

The conductor 2 is formed by twisting a plurality of strands together. For the strands, it is possible to use e.g. a rod of a tin-plated annealed copper wire or the like. The conductor 2 transmits electricity at high voltages of e.g. 7000 V or above.

The inner semiconductive layer 3 is provided so as to mitigate the concentration of the electric field, and is formed e.g. by dispersing an electrically conductive powder such as carbon or the like into a rubber, such as ethylene-propylene rubber, butyl rubber, or the like, to impart electrical conductivity to that rubber, and extrusion molding that electrically conductive rubber. Or it is also possible to use the same semiconductive resin composition as that of the outer semiconductive layer 5 for the inner semiconductive layer 3.

The electrically insulating layer 4 is formed e.g. by extrusion molding a material such as ethylene propylene rubber, vinyl chloride, crosslinked polyethylene, silicone rubber, a fluorine-based material, or the like.

The semiconductive tape layer 6 is formed by, in the cable longitudinal direction, helically overlap wrapping the semiconductive tape 60 around the outer circumference of the outer semiconductive layer 5 in such a manner that the tape 60 overlaps itself by e.g. ¼ to ½ its width. The semiconductive tape 60 may be formed e.g. by impregnating a woven base fabric with warp and weft therein or a nonwoven fabric made of nylon or rayon, PET or the like with a rubber such as ethylene-propylene rubber, butyl rubber or the like with an electrically conductive powder such as carbon or the like dispersed therein. The semiconductive tape 60 to be used may be e.g. not smaller than 0.1 mm and not greater than 0.4 mm in thickness, and not smaller than 30 mm and not greater than 70 mm in width.

The shielding layer 7 is formed by, in the cable axial direction, helically winding the wire 70 around the outer circumference of the semiconductive tape layer 6. The wire 70 may be formed of e.g. an electrically conductive material such as copper or the like. The wire 70 may use a wire rod having a diameter of e.g. not smaller than 0.4 mm and not greater than 0.6 mm. The shielding layer 7 is grounded when used.

The binder tape layer 8 is formed by, in the cable axial direction, helically overlap wrapping the binder tape 80 around the outer circumference of the shielding layer 7. The binder tape 80 may use a tape made of polyethylene having e.g. a thickness of not smaller than 0.03 mm and not greater than 0.5 mm, and a width of not smaller than 50 mm and not greater than 90 mm.

The sheath layer 9 is formed by extrusion molding a rubber with a crosslinking agent, etc. added thereto, such as natural rubber, butyl rubber, halogenated butyl rubber, ethylene-propylene rubber, chloroprene rubber, styrene butadiene rubber, nitrile rubber, chlorosulfonated polyethylene, chlorinated polyethylene, epichlorohydrin rubber, acrylic rubber, silicone rubber, fluorine rubber, urethane rubber, etc.

(Producing Method)

Next is described one example of a method of producing the power transmission cable 1.

Around the circumference of the conductor 2, the inner semiconductive layer 3, the electrically insulating layer 4, and the outer semiconductive layer 5 are extrusion molded in this order. Then, the semiconductive tape layer 6 is formed by, in the cable axial direction, helically wrapping the semiconductive tape 60 around the outer circumference of the outer semiconductive layer 5, the shielding layer 7 is formed by, in the cable axial direction, helically winding the wire 70 around the outer circumference of the semiconductive tape layer 6, and the binder tape layer 8 is formed by, in the cable axial direction, helically wrapping the binder tape 80 around the outer circumference of the shielding layer 7. Then, the sheath layer 9 is extrusion molded around the outer circumference of the binder tape layer 8. This is followed by vulcanization in conditions of not shorter than 5 min to not longer than 60 min in a continuous vulcanizing machine under an atmosphere at not lower than 150 degrees C. to not higher than 180 degrees C. In this manner, the power transmission cable 1 is produced.

The power transmission cable in the embodiment of the present invention can be used as e.g. high-voltage cables specially designed for rail vehicles, etc.

[Advantageous Effects of the Embodiment of the Present Invention]

The present invention can achieve a good easy peelability from the electrically insulating layer and extrudability, by the use of the semiconductive resin composition composed of the base polymer including the ethylene-vinyl acetate copolymer with a vinyl acetate content of not lower than 60 percent by weight, the two or more of fatty acid zinc, oleic acid bisamide and trimellitic acid ester, the peroxide-based crosslinking agent having a one hour half-life temperature of not lower than 130 degrees C., and the carbon having a DBP adsorption capacity of not larger than 150 mg/g.

EXAMPLES

The present invention is described more specifically by giving Examples below. These Examples are intended to present one aspect of the present invention, not limit the present invention, but any alterations may be made within the scope of the invention.

Around a tin-plated annealed copper stranded conductor having a nominal cross-sectional area of 120 $mm^2$, an inner semiconductive layer having a thickness of 1 mm, an electrically insulating layer having a thickness of 7.28 mm, and an outer semiconductive layer having a thickness of 1 mm were coated by co-extrusion. Its extrusion temperature was adjusted to from 80 degrees C. to 95 degrees C. This is followed by continuous vulcanization in conditions of a vapor pressure of 0.6 MPa, and a tube residence time of 30 minutes adjusted, resulting in power transmission cables to be evaluated in Examples and Comparative examples.

Combination compositions of electrically insulating layers were as follows. Antioxidizing agent, lubricant, etc. were combined in 100 parts by mass of EPDM composed of ENB 5.8 percent and ethylene 61 percent, 1.4 parts by mass of dicumyl peroxide, 55 parts by mass of calcined clay, and 5 parts by mass of zinc oxide. Combination compositions of outer semiconductive layers were those described in Table 1 and Table 2.

Materials used in the Examples and Comparative examples were as follows.

1) EVA (Levapren 600HV (Lanxess Corp. (Germany)) VA 60 percent)
2) EVA (Levapren 500HV (Lanxess Corp. (Germany)) VA 50 percent)
3) Zinc stearate (Nitto Kasei Co., Ltd.)
4) TOTM (trimellitic acid 2-ethylhexyl) available from Kao Corporation)
5) Oleic acid amide (SLIPAX O, available from Nippon Kasei Chemical Co., Ltd.)
6) Petroleum-derived low-crystalline paraffin wax (Hi-Mic-1080, available from Nippon Seiro Co., Ltd.)
7) 1,3-di(t-butyl peroxy isopropyl) benzene (Perbutyl P (1 hour half-life 141 degrees C., available from NOF Corporation))
8) Dicumyl peroxide (1 hour half-life 137 degrees C., available from NOF Corporation)
9) 1,1-di(t-butylperoxy)-3,3,5-cyclohexane (Trigonox 22 (1 hour half-life 112 degrees C., available from NOF Corporation))
10) TAIC (available from Hangzhou Keli Chemical Co., Ltd.)
11) Acetylene black (available from Denka Co., Ltd., Denka black, DBP adsorption 212 mg/g)
12) Ketjenblack (available from KISCO Co., Ltd., EC600JD, DBP adsorption 495 mg/g)
13) Furnace black (available from Tokai Carbon Co., Ltd., Seast G116, DBP adsorption 133 mg/g)
14) Antioxidizing agent (available from Songwon Inc., SONGNOX 1010)

The resulting power transmission cables were examined for extrudability, peel force, volume resistivity, tensile strength of the outer semiconductive layers, based on the following method.

(1) Extrudability:

Extrusion of the outer semiconductive layers was performed by using a 115 mm diameter extruder at a set temperature of 85 degrees C. The extrudability was determined as "Accepted" for a load current of the extruder of not greater than allowable electric current and for the absence of charring (carbonization) and swelling after extrusion, or as "Rejected" for a load current of the extruder exceeding allowable electric current or for the presence of charring or swelling after extrusion. The presence/absence of charring and swelling was identified by visual observation after extrusion.

(2) Peeling Force:

The adhesion of the outer semiconductive layer was evaluated according to peel strength when peeling the outer semiconductive layer from the electrically insulating layer. Specifically, each of the power transmission cables to be evaluated was vertically divided with a cutter, to produce three test pieces on the order of width 12.7 mm and length 15 cm. For this each test piece, a peeling test was performed with a Schopper tensile tester to measure their peel strengths when peeling the outer semiconductive layer at a tensile speed of 500 mm/min. If the measured peel strength is less than 10 N/12.7 mm, the adhesion of the outer semiconductive layer is too small. On the other hand, if the peel strength is greater than 50 N/12.7 mm, the adhesion of the outer semiconductive layer is too great, therefore when the outer semiconductive layer was peeled, the outer semiconductive layer itself was broken or the electrically insulating layer was broken. Thus, the peeling force was determined as "Accepted" for not less than 10 N/12.7 mm and less than 50 N/12.7 mm, or as "Rejected" for less than 10 N/12.7 mm, or greater than 50 N/12.7 mm.

(3) Electrical Properties:

The electrical properties of the outer semiconductive layer were evaluated according to volume resistivity of the outer semiconductive layer. Specifically, 80 mm long, 50 mm wide, and 1 mm thick test pieces were produced, and evaluated in compliance with JISK7194, in a room at 23±2 degrees C. by 9-point measurement. If the volume resistivity of the outer semiconductive layer is not more than 400 Ω·cm, it is possible to suppress partial discharge caused in the power transmission cables. Thus, the electrical properties of the outer semiconductive layer were determined as "Accepted" for a volume resistivity of not more than 400 Ω·cm, or as "Rejected" for a volume resistivity exceeding 400 Ω·cm.

TABLE 1

| | | | Examples | | | | |
|---|---|---|---|---|---|---|---|
| Combination | | | 1 | 2 | 3 | 4 | 5 |
| Base polymer | EVA (VA 60%) | 1) | 100 | 100 | 100 | 100 | 100 |
| | EVA (VA 50%) | 2) | | | | | |
| Additives | Zinc stearate | 3) | 1.88 | 1.18 | 1.18 | | 5.88 |
| | TOTM (trimellitic acid 2-ethylhexyl) | 4) | 5.88 | 11.76 | | 11.76 | 11.76 |

TABLE 1-continued

| | | | Examples | | | | |
|---|---|---|---|---|---|---|---|
| | Oleic acid amide | 6) | 5.88 | 5.88 | 5.88 | 5.88 | |
| | Petroleum-derived low-crystalline paraffin wax | 6) | | | | | |
| Crosslinkers | 1,3-di(t-butylperoxyisopropyl)benzene (1 hour half-life 141° C.) | 7) | 2.35 | 2.35 | 2.35 | 2.35 | 2.35 |
| | Dicumylperoxide (1 hour half-life 137° C.) | 8) | | | | | |
| | 1,1-di(t-butylperoxy)-3,3,5-cyclohexane (Trigonox 22 (1 hour half-life 112° C.)) | 9) | | | | | |
| Crosslinking promoter | TALC | 10) | 1.18 | 1.18 | 1.18 | 1.18 | 1.18 |
| Carbons | Acetylene black (Denks black) DBP adsorption 212 mg/g | 11) | | | | | |
| | Katjanblack (RC600JD) DBP adsorption 496 mg/g | 12) | | | | | |
| | Furnace black (Seast G116) DBP adsorption 133 mg/g | 13) | 76.47 | 76.47 | 76.47 | 76.47 | 76.47 |
| Antioxidizing agent | SONGNOX 1010 | 14) | 1.18 | 1.18 | 1.18 | 1.18 | 1.18 |
| Total | | | 194.8 | 200.0 | 188.2 | 198.8 | 198.8 |
| Total amount of fatty acid zinc, oleic acid bisamide and trimellitic acid ester | | | 13.6 | 18.8 | 7.1 | 17.6 | 17.6 |
| Total amount of EVA, fatty acid zinc, oleic acid bisamide and trimellitic acid ester | | | 113.6 | 118.8 | 107.1 | 117.6 | 117.6 |
| Total amount of crosslinkers | | | 2.7 | 2.8 | 2.5 | 2.8 | 2.8 |
| Total amount of carbons | | | 86.9 | 90.9 | 81.9 | 90.0 | 90.0 |
| Extrudability | | | Accepted | Accepted | Accepted | Accepted | Accepted |
| Peeling force | | | Accepted | Accepted | Accepted | Accepted | Accepted |
| Electrical properties | | | Accepted | Accepted | Accepted | Accepted | Accepted |

| Combination | | | 6 | 7 | 8 | 9 |
|---|---|---|---|---|---|---|
| Base polymer | EVA (VA 60%) | 1) | 100 | 100 | 100 | 100 |
| | EVA (VA 50%) | 2) | | | | |
| Additives | Zinc stearate | 3) | 1.18 | 1.88 | 1.88 | 1.88 |
| | TOTM (trimellitic acid 2-ethylhexyl) | 4) | | 5.88 | 5.88 | 5.88 |
| | Oleic acid amide | 6) | 5.88 | 5.88 | 5.88 | 5.88 |
| | Petroleum-derived low-crystalline paraffin wax | 6) | | | | |
| Crosslinkers | 1,3-di(t-butylperoxyisopropyl)benzene (1 hour half-life 141° C.) | 7) | 2.35 | 1.4 | 2.6 | 2.35 |
| | Dicumylperoxide (1 hour half-life 137° C.) | 8) | | | | |
| | 1,1-di(t-butylperoxy)-3,3,5-cyclohexane (Trigonox 22 (1 hour half-life 112° C.)) | 9) | | | | |
| Crosslinking promoter | TALC | 10) | 1.18 | 1.18 | 1.18 | 1.18 |
| Carbons | Acetylene black (Denks black) DBP adsorption 212 mg/g | 11) | | | | |
| | Katjanblack (RC600JD) DBP adsorption 496 mg/g | 12) | | | | |
| | Furnace black (Seast G116) DBP adsorption 133 mg/g | 13) | 94.4 | 76.47 | 76.47 | 58.5 |
| Antioxidizing agent | SONGNOX 1010 | 14) | 1.18 | 1.18 | 1.18 | 1.18 |
| Total | | | 206.2 | 193.9 | 195.1 | 176.9 |
| Total amount of fatty acid zinc, oleic acid bisamide and trimellitic acid ester | | | 7.1 | 13.6 | 13.6 | 13.6 |
| Total amount of EVA, fatty acid zinc, oleic acid bisamide and trimellitic acid ester | | | 107.1 | 113.6 | 113.6 | 113.6 |
| Total amount of crosslinkers | | | 2.5 | 1.6 | 3.0 | 2.7 |
| Total amount of carbons | | | 101.1 | 86.9 | 86.9 | 66.5 |
| Extrudability | | | Accepted | Accepted | Accepted | Accepted |
| Peeling force | | | Accepted | Accepted | Accepted | Accepted |
| Electrical properties | | | Accepted | Accepted | Accepted | Accepted |

TABLE 2

| | | | Comparative examples | | | | | |
|---|---|---|---|---|---|---|---|---|
| Combination | | | 1 | 2 | 3 | 4 | 5 | 6 |
| Base polymer | EVA (VA 60%) | 1) | 0 | 100 | 100 | 100 | 100 | 100 |
| | EVA (VA 50%) | 2) | 100 | | | | | |
| Additives | Zinc stearate | 3) | 1.88 | 5.88 | | | 1.88 | 1.18 |
| | TOTM (trimellitic acid 2-ethylhexyl) | 4) | 5.88 | | 5.88 | | 5.88 | 5.88 |

TABLE 2-continued

| | Combination | | Comparative examples 1 | 2 | 3 | 4 | 5 | 6 |
|---|---|---|---|---|---|---|---|---|
| | Oleic acid amide | 5) | 5.88 | | | 5.88 | 5.88 | 5.88 |
| | Petroleum-derived low-crystalline paraffin wax | 6) | | | | | | |
| Crosslinkers | 1,3-di(t-butylperoxyisopropyl)benzene (1 hour half-life 141° C.) | 7) | 2.35 | 2.35 | 2.35 | 2.35 | 2.35 | 2.35 |
| | Dicumylperoxide (1 hour half-life 137° C.) | 8) | | | | | | |
| | 1,1-di(t-butylperoxy)-3,3,5-cyclohexane (Trigonox 22 (1 hour half-life 112° C.) | 9) | | | | | | |
| Crosslinking promoter | TALC | 10) | 1.18 | 1.18 | 1.18 | 1.18 | 1.18 | 1.18 |
| Carbons | Acetylene black (Denka black) DBP adsorption 212 mg/g | 11) | | | | | 76.47 | |
| | Katjanblack (EC600JD) DBP adsorption 495 mg/g | 12) | | | | | | 76.47 |
| | Furnace black (Seast G116) DBP adsorption 133 mg/g | 13) | 76.47 | 76.47 | 76.47 | 76.47 | | |
| Antioxidizing agent | SONGNOX 1010 | 14) | 1.18 | 1.18 | 1.18 | 1.18 | 1.18 | 1.18 |
| | Total | | 194.8 | 187.1 | 187.1 | 187.1 | 194.8 | 194.1 |
| | Extrudability | | Accepted | Rejected | Accepted | Rejected | Rejected | Rejected |
| | Peeling force | | Rejected | Accepted | Rejected | Accepted | Accepted | Accepted |
| | Electrical properties | | Accepted | Accepted | Accepted | Accepted | Accepted | Accepted |

From the results shown in Table 1, it was found that the outer semiconductive layers of the power transmission cables produced in Examples 1 to 9 had the good extrudability. In contrast, Comparative examples 1 to 6 shown in Table 2 had problems with either their extrudability or their peeling force.

In Comparative example 1, because of the ethylene vinyl acetate copolymer having the vinyl acetate content of lower than 60 percent by weight, the peelability between the outer semiconductive layer and the electrically insulating layer excessively lowered, and was poor. Comparative example 1 was rejected.

In Comparative example 2, because the system used zinc stearate as a single agent, the extrudability was poor. Comparative example 2 was rejected.

In Comparative example 3, because the system used trimellitic acid 2-ethylhexyl as a single agent, the peelability was poor. Comparative example 3 was rejected.

In Comparative example 4, because the system used oleic acid amide as a single agent, the extrudability was poor. Comparative example 4 was rejected.

In Comparative examples 5 and 6, because of the use of the DBP absorption amount larger than 150 mg/g, the extrudability was poor. Comparative examples 5 and 6 were rejected.

Figure 2:
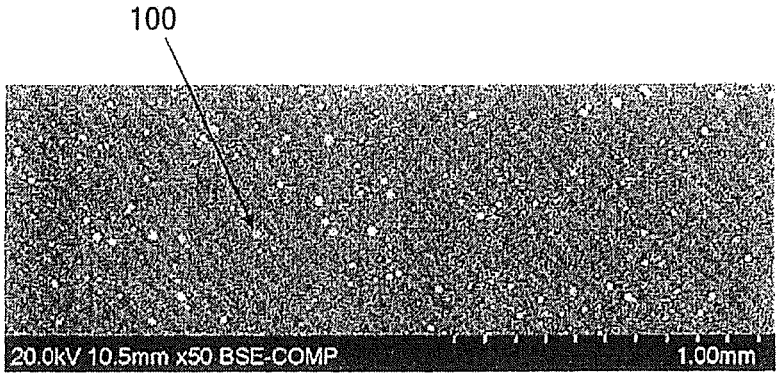
FIG. 2 is a photograph showing a phase structure of a semiconductive resin composition in one embodiment of the present invention.
Figures 3A, 3B, 3C, 3D, 3E, 3F:
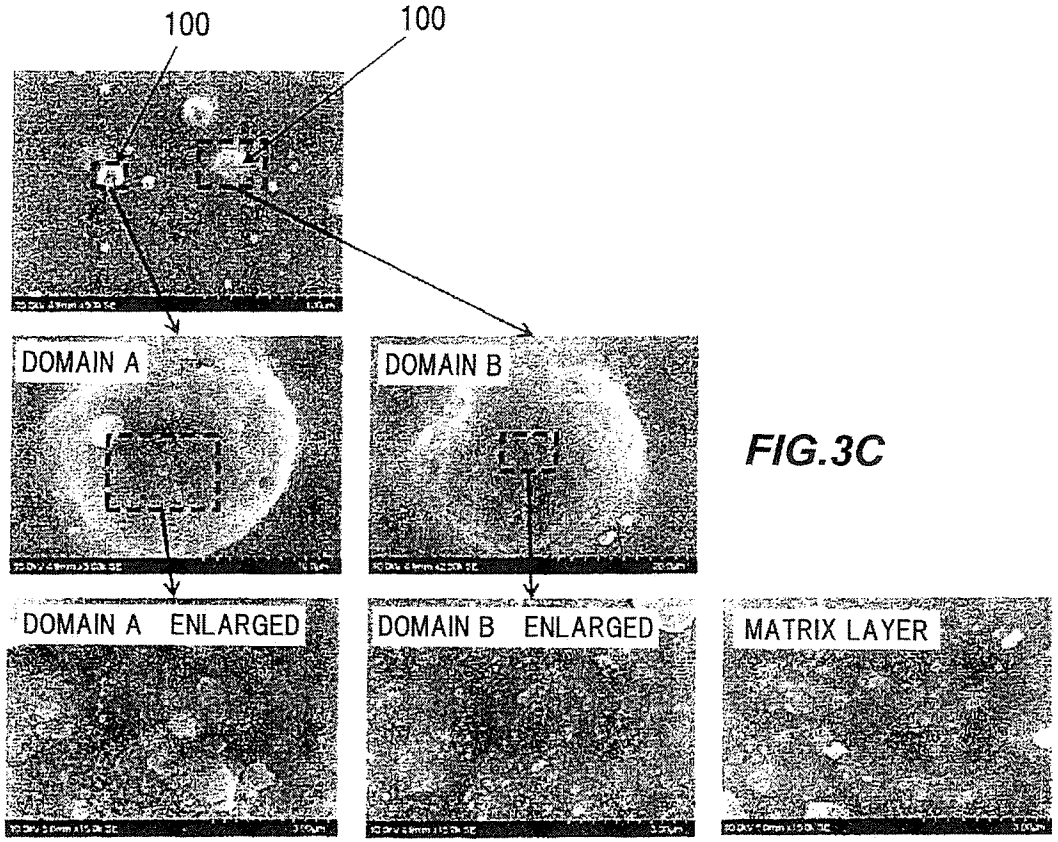
FIG. 3A is an enlarged photograph showing the phase structure of the semiconductive resin composition in the one embodiment of the present invention.
FIG. 3B is an enlarged photograph showing each domain layer of the phase structure of the semiconductive resin composition in the one embodiment of the present invention.
FIG. 3C is an enlarged photograph showing each domain layer of the phase structure of the semiconductive resin composition in the one embodiment of the present invention.
FIG. 3D is a further enlarged photograph showing the domain layer in FIG. 3B of the phase structure of the semiconductive resin composition in the one embodiment of the present invention.
FIG. 3E is a further enlarged photograph showing the domain layer in FIG. 3C of the phase structure of the semiconductive resin composition in the one embodiment of the present invention.
FIG. 3F is an enlarged photograph showing a matrix layer of the semiconductive resin composition in the one embodiment of the present invention.

Note that after peeling the outer semiconductive layer produced in Example 1, the peeled surface was observed by using a SEM-EDX analyzer. The results are shown in FIG. 2. The domain with white carbons having a particle size of around 30 μm dispersed therein was identified in the matrix layer with carbons dispersed therein. Also in FIGS. 3A to 3C, the carbon dispersed states in the domain and the matrix layer were identified (The domain was identified at 2 points A and B). It was identified that there were no significant differences in the carbon particle dispersed states in the domains A and B and in the matrix layer, and that the domains A and B and the matrix layer were composed of aggregated carbon particles of the order of 30 nm, in which the carbon particles themselves maintained their shapes.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A power transmission cable comprising an outer semiconductive layer including a semiconductive resin composition, wherein the semiconductive resin composition comprises:

a base polymer including an ethylene-vinyl acetate copolymer with a vinyl acetate content of not lower than 60 percent by weight;

zinc stearate, oleic acid bisamide, and trimellitic acid 2-ethylhexyl;

a peroxide-based crosslinking agent having a one hour half-life temperature of not lower than 130 degrees C., the peroxide-based crosslinking agent consisting of 1,3-di(t-butylperoxy isopropyl) benzene; and a carbon black having a DBP (dibutyl phthalate) adsorption capacity of not larger than 150 mg/g;

including not less than 6 parts by mass and not more than 19 parts by mass of the zinc stearate, oleic acid bisamide, and the trimellitic acid 2-ethylhexyl per 100 parts by mass of the base polymer.

2. The power transmission cable according to claim 1, including not less than 0.5 parts by mass and not more than 3 parts by mass of the peroxide-based crosslinking agent, per a total of 100 parts by mass of the base polymer and the zinc stearate, oleic acid bisamide, and trimellitic acid 2-ethylhexyl.

3. The power transmission cable according to claim 1, including not less than 50 parts by mass and not more than 95 parts by mass of the carbon black, per a total of 100 parts by mass of the base polymer and the zinc stearate, oleic acid bisamide, and trimellitic acid 2-ethylhexyl.

4. The power transmission cable according to claim 1, wherein a particle size of the carbon black is not smaller than 30 μm and is smaller than 100 μm.

5. The power transmission cable according to claim 1, wherein the semiconductive resin composition includes not less than 2 parts by mass and not more than 2.8 parts by mass of the peroxide-based crosslinking agent, per a total of 100 parts by mass of the base polymer and the zinc stearate, oleic acid bisamide, and trimellitic acid 2-ethylhexyl.

6. The power transmission cable according to claim 1, wherein the carbon black has the DBP adsorption capacity in a range from 50 mg/g to 150 mg/g.

7. The power transmission cable according to claim 6, wherein the carbon black has a pellet shape having an average particle size in a range from 30 μm to 100 μm.

8. The power transmission cable according to claim 1, further comprising:

a conductor comprising a stranded wire; and an inner semiconductive layer disposed around a circumference of the conductor.

9. The power transmission cable according to claim 8, wherein the inner semiconductive layer has a same composition as the outer semiconductive layer.

10. The power transmission cable according to claim 8, further comprising:

an electrically insulating layer disposed between an outer circumference of the inner semiconductive layer and an inner circumference of the outer semiconductive layer.

11. The power transmission cable according to claim 10, wherein the electrically insulating layer comprises one of an ethylene propylene rubber, vinyl chloride, a crosslinked polyethylene, a silicone rubber, and a fluorine-based material.

12. The power transmission cable according to claim 10, further comprising:

a semiconductive tape layer including a serniconductive tape wrapped around an outer circumference of the outer semiconductive layer.

13. The power transmission cable according to claim 12, wherein the semiconductive tape includes a woven base fabric impregnated with a warp and a weft.

14. The power transmission cable according to claim 12, further comprising:

a shielding layer including a wire wound around an outer circumference of the semiconductive tape layer.

15. The power transmission cable according to claim 14, further comprising:

a binder tape layer including a binder tape comprising polyethylene, the binder tape being wound around an outer circumference of the shielding layer.

* * * * *